US011813660B2

(12) United States Patent
Bastoni

(10) Patent No.: US 11,813,660 B2
(45) Date of Patent: Nov. 14, 2023

(54) WIRE TYING TOOL

(71) Applicant: Mark L. Bastoni, Arlington, MA (US)

(72) Inventor: Mark L. Bastoni, Arlington, MA (US)

( * ) Notice: Subject to any disclaimer, the term of this patent is extended or adjusted under 35 U.S.C. 154(b) by 0 days.

(21) Appl. No.: 17/443,749

(22) Filed: Jul. 27, 2021

(65) Prior Publication Data

US 2022/0023933 A1 Jan. 27, 2022

Related U.S. Application Data

(62) Division of application No. 16/615,106, filed as application No. PCT/US2018/033237 on May 17, 2018, now Pat. No. 11,103,915.

(60) Provisional application No. 62/508,785, filed on May 19, 2017.

(51) Int. Cl.

| | |
|---|---|
| ***B21F 15/04*** | (2006.01) |
| ***B65B 13/28*** | (2006.01) |
| ***B21F 27/08*** | (2006.01) |
| ***E04G 21/12*** | (2006.01) |

(52) U.S. Cl.

CPC ..... *B21F 15/04* (2013.01); *B21F 27/08* (2013.01); *B65B 13/28* (2013.01); *B65B 13/285* (2013.01); *E04G 21/123* (2013.01)

(58) Field of Classification Search

CPC ..... B65B 13/28; B65B 13/285; B65B 13/04; B65B 13/06; E04G 21/123; B21F 7/00; B21F 15/04; B21F 23/00; B21F 23/05

USPC ..... 140/118, 119, 149

See application file for complete search history.

(56) References Cited

U.S. PATENT DOCUMENTS

2018/0207710 A1* 7/2018 Itagaki ..... B65B 13/285

* cited by examiner

*Primary Examiner* — Bobby Yeonjin Kim

(74) *Attorney, Agent, or Firm* — Jonathan M. D'Silva; MMI Intellectual Property

(57) ABSTRACT

An apparatus for twist tying wire around intersecting rebar bars. The apparatus is configured to receive and discharge precut wire segments, form and wrap the wire around the rebar, and twist the wire securely around the rebar. The user merely positions the tool at the rebar intersection, release a wire segment into the work end of the tool, and with a single fluid motion move a slide mechanism up to bend the wire segment around the rebar and twist it about itself to tie the rebar together.

3 Claims, 15 Drawing Sheets

WIRE TYING TOOL

CROSS-REFERENCE TO RELATED APPLICATION(S)

This application claims priority to, and the benefit of, U.S. Provisional Application No. 62/508,785, filed May 19, 2017, for all subject matter common to both applications. The disclosure of said provisional application is hereby incorporated by reference in its entirety.

FIELD OF THE INVENTION

The present invention relates to a wire tying apparatus suitable for tying a wire segment around objects to secure the objects together in place. In particular, the present invention relates to a wire tying tool for tying precut wire segments around reinforcing steel bars, or rebar, from an upright position, and twisting the wire segments about themselves to secure the rebar in place.

BACKGROUND

Generally, in concrete construction, concrete structures are reinforced by a lattice or skeleton of steel bars called "rebar", which must be tied/held together by twisted wire for stability. Traditionally, tying together the rebar with wire is done by hand (e.g., with pliers). In particular, the wire is manually wrapped around the two rebar pieces and the ends of the wire are manually twisted together using pliers or another tool. The manual process is a time-consuming and physically demanding process. Specifically, the repeated process of having a worker kneel and/or bend down and twist the wire thousands of times per day is taxing on the worker's body as well as being time intensive. Such physical stress of conventional tying methods negatively impacts productivity and morale of the workers. There are devices that help the rebar securing process however, these devices have a combination of shortcomings. For example, existing devices on the market require some combination of batteries, cords, specialized fuels, etc. Additionally, these devices can be difficult to utilize, maintain (e.g., jamming, battery life, etc.), and/or to replace.

SUMMARY

There is a need for an improved system and method for tying together rebar in concrete construction. The present invention is directed toward further solutions to address this need, in addition to having other desirable characteristics. Specifically, the tool of the present invention provides an improved system and method for tying wire around rebar sections. The tool is configured to receive and discharge precut wire segments, form and wrap the wire segments around the rebar, and twist the wire segments securely around themselves, fastening the intersecting rebar pieces in place, while requiring minimal effort from a user. In particular, the tool of the present invention combines mechanical and manual energy to wrap a pre-cut/formed wire segment around two or more rebar members, typically at their intersection, then twist it tightly to hold the rebar members in place. Additionally, the process executed by the tool is performed by a user while the user stands in an upright position. The functionality of the tool solves a long-standing ergonomic problem whereby a worker prior to the present invention must spend long hours in a bent-over position tying wire with hand-held pliers or the like. In contrast, the tool of the present invention provides an improved result which produces substantially uniform ties.

In accordance with example embodiments of the present invention, an apparatus for tying reinforcing steel bars together with a wire includes an elongate housing having a handle at one end and a work end. A wire feed is configured to contain at least one wire segment. A puller arm has a first end and a second end. A wire engager is coupled with the puller arm at the second end of the puller arm. A catch pin is disposed in the wire engager. A wire forming block is located proximate the work end of the elongate housing. The apparatus further includes a wire twisting assembly that includes a twist head having a first end and a second end; a twist hub coupled to the twist head at the second end of the twist head; and a twist shaft bushing coupled to the twist hub and configured at an opposite end of the twist hub from the twist head. A rotatable shaft is disposed within the elongate housing and having a first end and a second end, the second end coupled with the wire twisting assembly. A channel transitions from a generally straight section to a generally helical section disposed along a length of the rotatable shaft. A slidable actuator is coupled with the puller arm and at least one pin disposed in a manner engaging the channel. With a wire segment disposed in the wire feed, the wire segment is dropped into the wire engager. The slidable actuator is slid up and away from the work end, which action simultaneously pulls the wire segment across the wire forming block bending an end of the wire into a first catch and also causes the at least one pin to travel along the generally straight section of the channel. The first catch of the wire segment catches the catch pin in the wire engager, causing the wire segment to be removably coupled with the catch pin of the wire engager. The slidable actuator continues up and away from the work end, causing the wire engager to pull additional length of the wire segment out of the wire feed until reaching a desired length that is less than a full length of the wire segment. The slidable actuator continues up and away from the work end, causing the at least one pin to enter and travel along the generally helical section, which in turn causes the shaft to rotate and simultaneously cause the wire twisting assembly to rotate. The rotating action of the wire twisting assembly causes the wire segment to bend as it moves past an end of the wire feed, creating a second catch at an end of the wire segment opposite the first catch. The slidable actuator continues up and away from the work end, causing the shaft to rotate and simultaneously causing the wire twisting assembly to rotate, the wire twisting assembly engaging the first catch and the second catch of the wire segment, and causing the wire to twist about itself.

In accordance with aspects of the present invention, the slidable actuator can be coupled to the puller arm at the first end of the puller arm. The apparatus can further include a cam plate encasing the puller arm; and a puller path configured as a cavity within and following a contour of the cam plate. The apparatus can further include a driver reset mechanism; and a load spool. The load spool is configured to receive a specialized drum magazine comprising pre-cut pieces of the wire. The apparatus can further include a driver spring coupled to the slidable actuator. An upper wire forming block can be located proximate a cowling of the wire twisting assembly.

In accordance with embodiments of the present invention, a method for tying reinforced steel bars together with a wire includes slipping an open end of a wire tying apparatus under and around at least two intersecting reinforced steel bar members. A trigger mechanism on the apparatus is actuated, wherein the trigger causes a release of energy of a spring loaded driver to push a pre-cut piece of wire into a wire forming tool of the apparatus. A user pulls upward on a handle of the apparatus, wherein pulling upward on the handle causes a first end of the pre-cut piece of wire to be bent at an angle. Continuing the pulling upward on the handle, the continued pulling upward causes the first end of the pre-cut piece of wire and a second end of the pre-cut piece of wire to be positioned in a twist position proximal to a wire twisting assembly. Continuing the pulling upward on the handle, the continued pulling upward causes the wire twisting assembly of the apparatus to rotate the first end of the pre-cut piece of wire and the second end of the pre-cut piece of wire in opposite direction causing the wire to twist and tighten around the at least two intersecting reinforced steel bar members.

In accordance with aspects of the present invention, the method further includes dispensing the wire from an indexing drum magazine into a driver channel. The angle can be substantially a 90 degree angle.

BRIEF DESCRIPTION OF THE FIGURES

These and other characteristics of the present invention will be more fully understood by reference to the following detailed description in conjunction with the attached drawings, in which.

DETAILED DESCRIPTION

Figure 1:
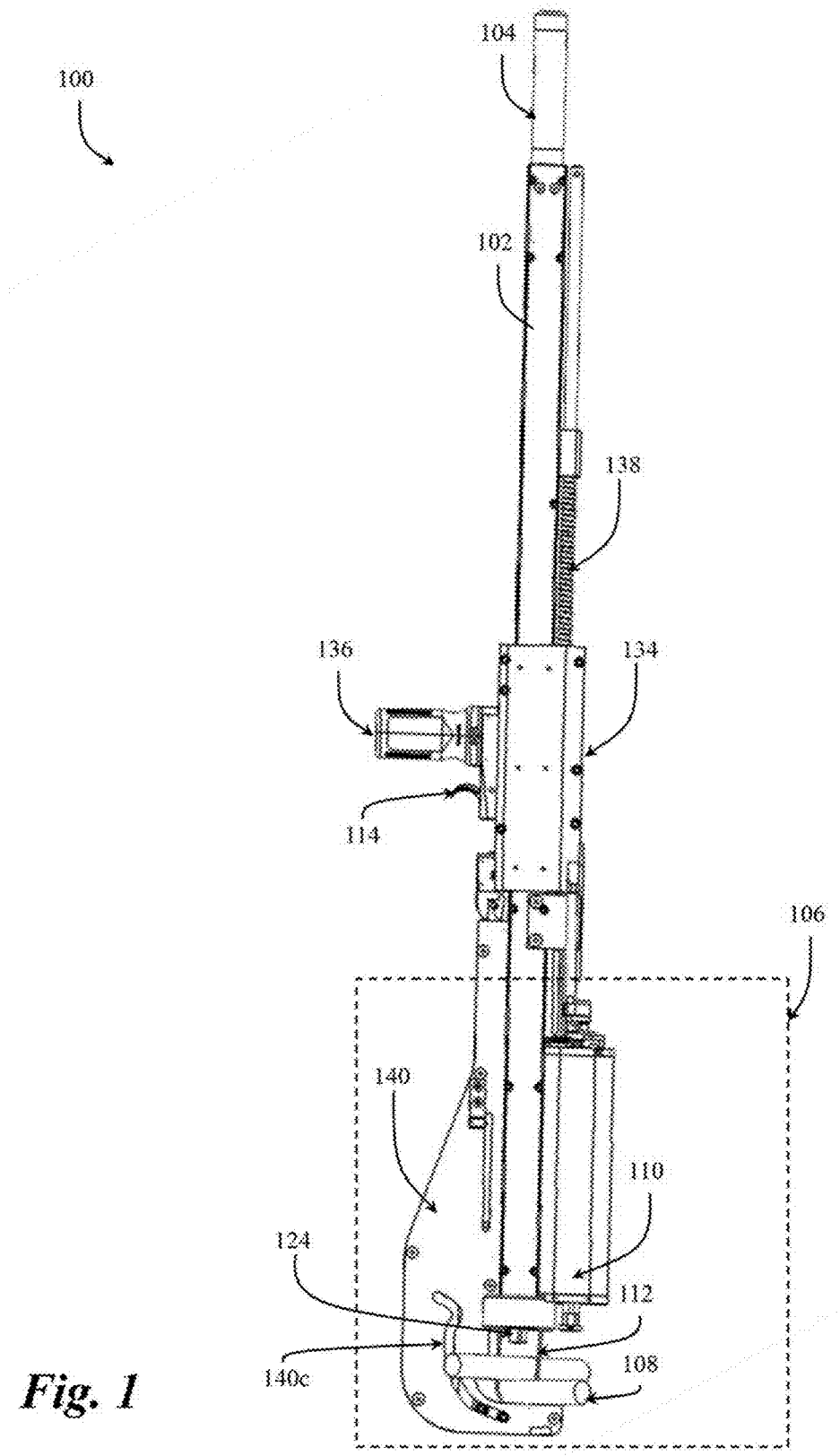
FIG. 1 is an illustrative example of the complete tool, in accordance with the present invention.

An illustrative embodiment of the present invention relates to a mechanical wire tying tool configured to mechanically twist tie a wire around an intersection of rebar members while the user stands in an upright position. The wire tying tool includes a trigger mechanism and a slidable actuator mechanism that enables a user to discharge a wire segment (e.g., via operation of the trigger mechanism) and subsequently wrap and twist the wire segment around the intersection of two or more pieces of rebar (e.g., via operation of the slidable actuator). Specifically, by actuating a trigger mechanism, a wire segment is discharged by the tool into a position to be pulled around the target objects and subsequently twisted about itself and to fasten the objects (e.g., rebar intersection) together. The pulling and twisting of the wire is caused in response to the user pulling the slidable actuator in a single upward motion. Once the twisting is completed the wire is disengaged from the tool and the tool can be repositioned for placement of twisted wire at another location. The operation of the tool of the present invention replaces the traditional user kneeling/bending over and hand twisting wire with a simple and quick one or two motion process from a standing position.

The functionality of the present invention is enabled by a combination of key elements that make up the wire tying tool. Some of the elements include a wire forming mechanism, a twist head and wire twisting assembly, and a slidable actuator engaging with a rotatable shaft attached to the wire twisting assembly. The configuration of the wire forming mechanism and a puller arm combine to deliver the leading end of the wire into the proper position which facilitates tying/twisting of the wire around the objects. Additionally, the shape of the twist head combined with the configuration of the wire twisting assembly with the rotatable shaft enable the tying function of the tool. In particular, when a wire segment is discharged in response to actuating the trigger mechanism, the wire segment is positioned within the wire forming mechanism such that it engages with the puller arm when the user pulls upward on the slidable actuator. In response to pulling up the slidable actuator, the puller arm pulls the wire piece down and around the objects and back up proximate to the twist head. Within the same pulling motion of the slidable actuator, the twist head engages either side of the wire piece and the wire twisting assembly causes the twist head to rotate (e.g., via the rotatable shaft) to twist the wire segment around the objects.

The present invention is described with respect to an example implementation of tying wire around reinforcing bar (e.g., rebar) but as would be appreciated by one skilled in the art, the example implementation is not intended to limit the tool of the present invention to tying wire pieces around rebar. Accordingly, the tool of the present invention can be adjusted to perform tying operations for multiple different applications without departing from the scope of the present invention. Additionally, although the present invention is discussed primarily as a hand-operated tool, it can also be adapted to be an automated power tool without departing from the scope of the present invention.

FIGS. 1 through 11, wherein like parts are designated by like reference numerals throughout, illustrate an example embodiment or embodiments of a wire tying tool, according to the present invention. Although the present invention will be described with reference to the example embodiment or embodiments illustrated in the figures, it should be understood that many alternative forms can embody the present invention. One of skill in the art will additionally appreciate different ways to alter the parameters of the embodiment(s) disclosed, such as the size, shape, or type of elements or materials, in a manner still in keeping with the spirit and scope of the present invention.

FIG. 1 depicts an illustrated example of the wire tying tool 100. The tool 100, as depicted in FIG. 1, is configured for tying reinforcing steel bars (rebar) together by twisting a wire segment around the rebar. The tool 100 includes an elongate housing 102 having a handle 104 at one end and a work end 106 at the opposite end of the elongate housing 102. The elongate housing 102 is the housing for the various components, mechanisms, and assemblies of the tool 100. As would be appreciated by one skilled in the art, the elongate housing 102 can include any combination of shapes configured to house the components, mechanisms, and assemblies of the tool 100 discussed herein. Additionally, the elongate housing 102 can include any combination of pieces, coupled together and constructed from a combination of materials through any known methodologies. For example, the elongate housing 102 can be constructed from a single cast, three dimensional printing construction, or can be constructed from a combination of individual parts coupled together (e.g., rivets, screws, welds, etc.).

In accordance with an example embodiment of the present invention, the handle 104 is a vertical grip handle positioned at a top end of the elongate housing 102 and the work end 106 is positioned on the opposite end of the elongate housing 102. The handle 104 is configured to provide a user with a gripping surface to securely position and hold the tool 100 in a vertical position during operation. The handle 104 can be constructed in any ergonomic shape (e.g., cylindrical, ribbed, etc.) from any combination of materials (e.g., aluminum, rubber, plastic, etc.) to enable adequate gripping of the tool 100 during operation. As would be appreciated by one skilled in the art, the handle 104 could be positioned at different locations on the elongate housing 102 and a different orientation without departing from the scope of the present invention. For example the handle 104 could be positioned perpendicular to the elongate housing 102.

Figure 2:
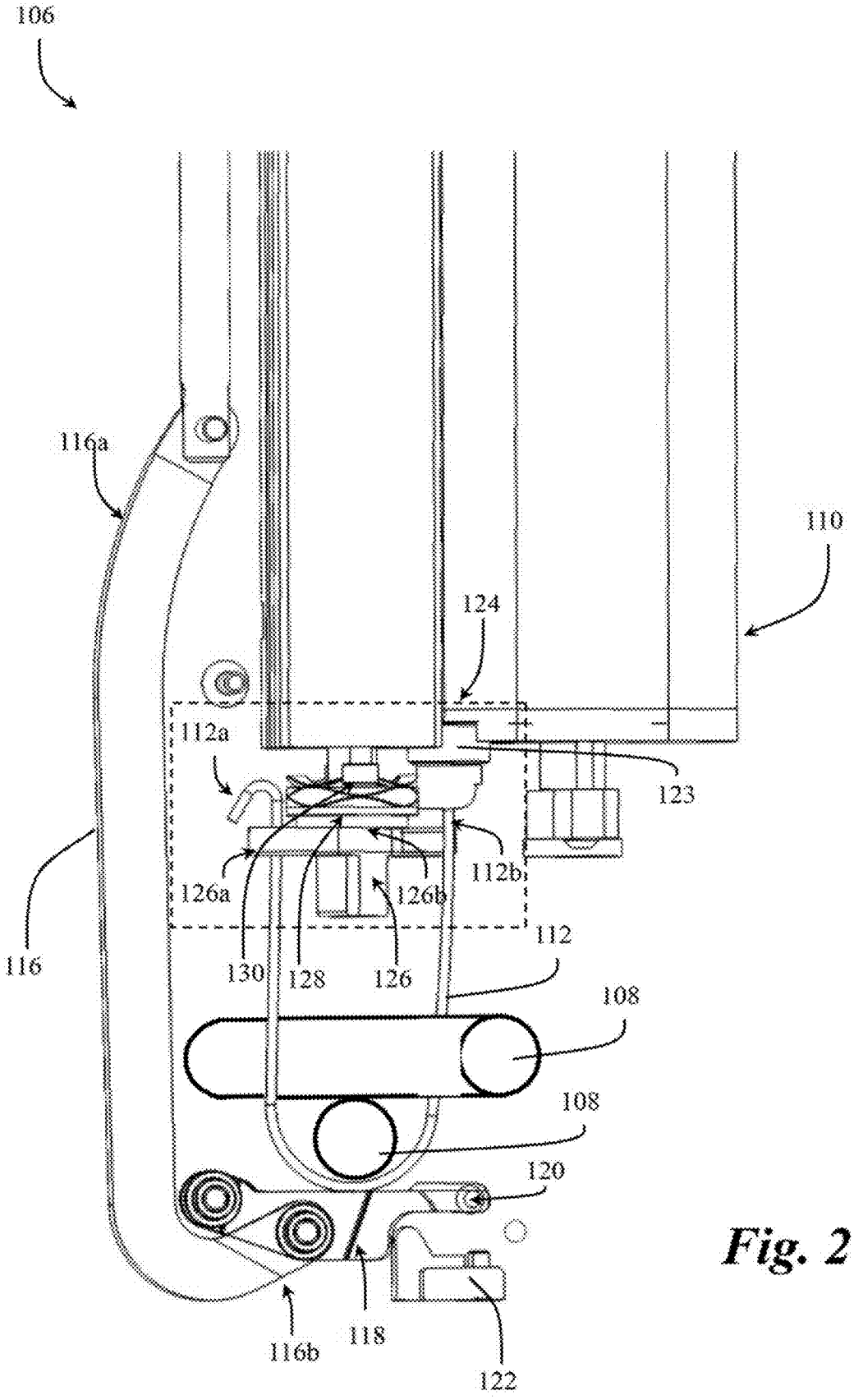
FIG. 2 is an illustrative example of the wire twist assembly of the tool, in accordance with the present invention.

The work end 106 of the tool 100 includes the mechanisms for placement and twisting of the wire segment around objects to be tied together (e.g., rebar 108). In particular, the work end 106 of the tool 100 is a hook shape at the end of the tool 100 in which the user positions proximate to and underneath the objects that the user desires to tie together, as depicted in FIG. 2. Additionally, the work end 106 includes an opening section to position objects to be tied between the components of the work end (e.g., between a wire engager and twisting assembly). As would be appreciated by one skilled in the art, the object(s) can include anything which fits in the open end of the work end 106 of the tool 100 which needs a twisted wire tie. For example, the work end 106 is placed and orientated proximate two rebar sections 108 that are desired to be tied together with the tool 100. Similarly, the work end 106 can be adjustable to accommodate different size members, different length wires, etc.

Continuing with FIG. 1, the work end 106 of the tool 100 includes a wire feed 110 configured to contain at least one wire segment 112. The at least one wire segment 112 is the wire to be used in tying together the rebar 108. In accordance with an example embodiment of the present invention, the wire feed 110 is configured to discharge the at least one wire segment 112 in a vertical position perpendicular to the rebar 108 in response to a user activating a trigger 114. As would be appreciated by one skilled in the art, the trigger 114 can include any combination of triggering mechanisms known in the art. For example, the trigger 114 can be a modified rifle trigger causing a spring to discharge a wire segment 112 from the wire feed 110. In another example, the trigger 114 can be integrated into a slidable actuator mechanism.

In response to the activation of the trigger 114, the wire segment 112 is discharged in a position to begin the process of forming, wrapping, and tying the at least one wire segment 112 around the rebar 108 (e.g., proximate to a wire engager of a puller arm). As would be appreciated by one skilled in the art, the wire feed 110 can include any combination of mechanisms configured to hold at least one wire segment 112 and discharge the at least one wire segment 112 in response to activation of a triggering mechanism (e.g., actuating or pulling the trigger 114). For example, the wire feed 110 can include a load spool configured to receive a specialized drum magazine of pre-cut pieces of wire segment 112 to be discharged and rotated via a driver reset mechanism.

Figure 3:
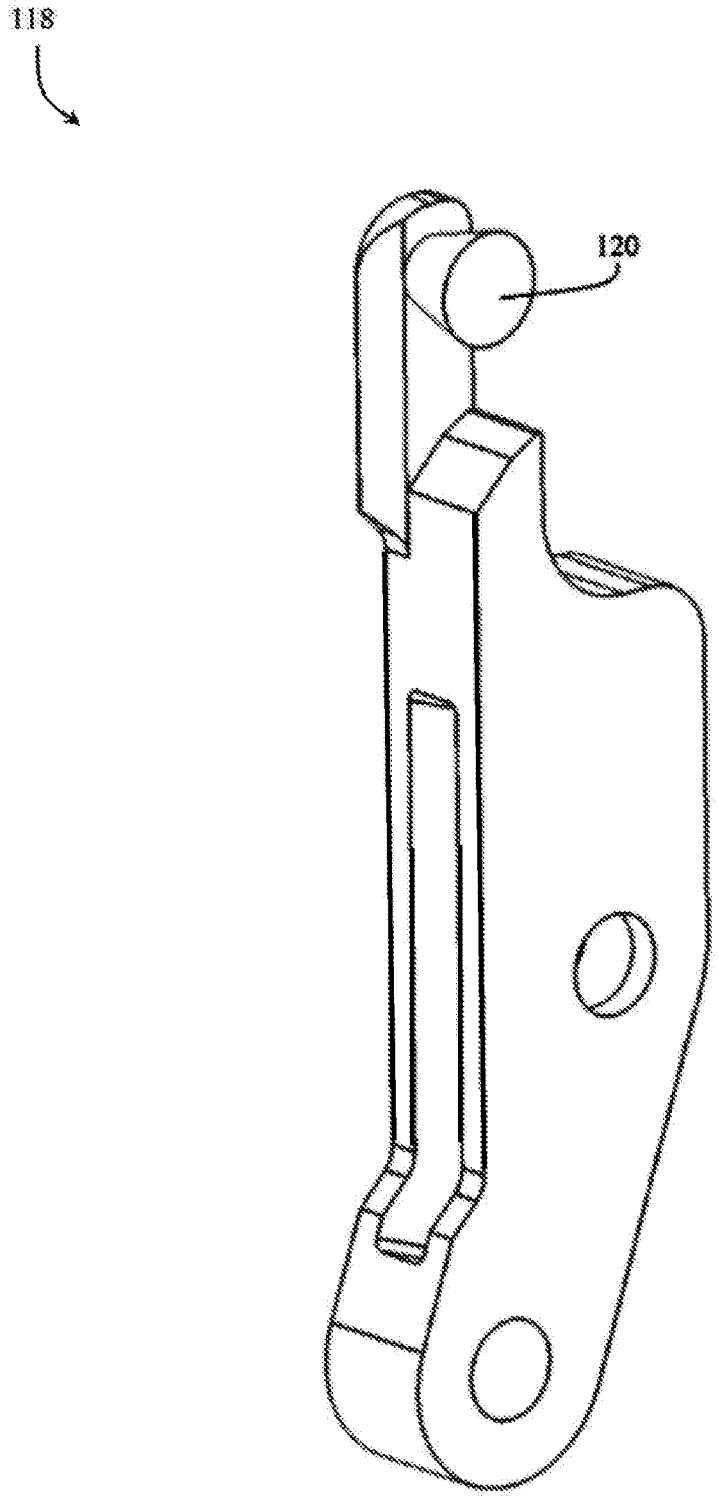
FIG. 3 is an illustrative example of the wire engager of the tool, in accordance with the present invention.

The work end 106 of the tool 100 also includes a puller arm 116 having a first end 116*a* and a second end 116*b*. The puller arm 116 is configured to pull a first end 112*a* of the wire segment 112 under the sections of rebar 108 and up into a twisting position, as depicted in FIG. 2. In accordance with an example embodiment of the present invention, the puller arm 116 includes a wire engager 118 at the second end 116*b* of the puller arm 116. The wire engager 118 is configured to pivot and move with the puller arm 116 to pull the first end 112*a* of the wire segment 112 into the twisting position. Additionally, the wire engager 118 includes a catch pin 120 disposed in the wire engager 118, as depicted in greater detail in FIG. 3. The catch pin 120 is configured to catch and engage with the first end 112*a* of the wire segment 112 when the puller arm 116 and the wire engager 118 are pulled toward the twisting position. In other words, the catch pin 120 applies a pushing force against the first end 112*a* of the wire segment 112 in the direction that the puller arm 116 and wire engager 118 are pulled. In accordance with an example embodiment of the present invention, the catch pin 120 is a conical frustum shape positioned with the base positioned away from the wire engager 118, as depicted in FIG. 3. The conical frustum shape is configured to hold the wire segment 112 against the catch pin 120 as the wire segment 112 is pulled (e.g., via the puller arm 116/wire engager 118). The conical frustum shape of the catch pin 120 also provides some resistance as a twist head 126 catches the wire segment 112 and pulls the wire segment 112 off of the catch pin 120, as discussed in greater detail herein. The resistance provided by the catch pin 120 helps with the cinch along with a bending element located proximate the second end 112*b* of the wire segment 112.

In accordance with an example embodiment of the present invention, the work end 106 of the tool 100 also includes a stationary wire forming block 122. The wire forming block 122 is a boot shaped structure with the toe portion of the boot shape of the wire forming block 122 extending vertically toward the wire engager 118, as depicted in FIG. 2. As would be appreciated by one skilled in the art, the wire forming block 122 can be configured in a variety of shapes and is not limited to the shape provided in FIG. 2. Additionally, the wire forming block 122 can include multiple blocks to form the wire in a particular manner. The wire forming block 122, used in conjunction with the catch pin 120, is configured to form a bend in the first end 112*a* of the wire segment 112. In particular, the bend is formed when the first end 112*a* of the wire segment 112 is pulled and wedged between the catch pin 120 and the protruding portion of the wire forming block 122, such that as force is applied by the catch pin 120, the first end 112*a* of the wire segment 112 is bent by the force provided against the stationary wire forming block 122. In accordance with an example embodiment of the present invention, the bend in the first end 112*a* of the wire segment 112 is formed by the first end 112*a* being partially bent around the catch pin 120. As would be appreciated by one skilled in the art, the wire forming block 122 can include any shape configured to form a bend in the first end 112*a* of the wire segment 112 as the wire segment 112 is pulled against and past the wire forming block 122.

Figure 5:
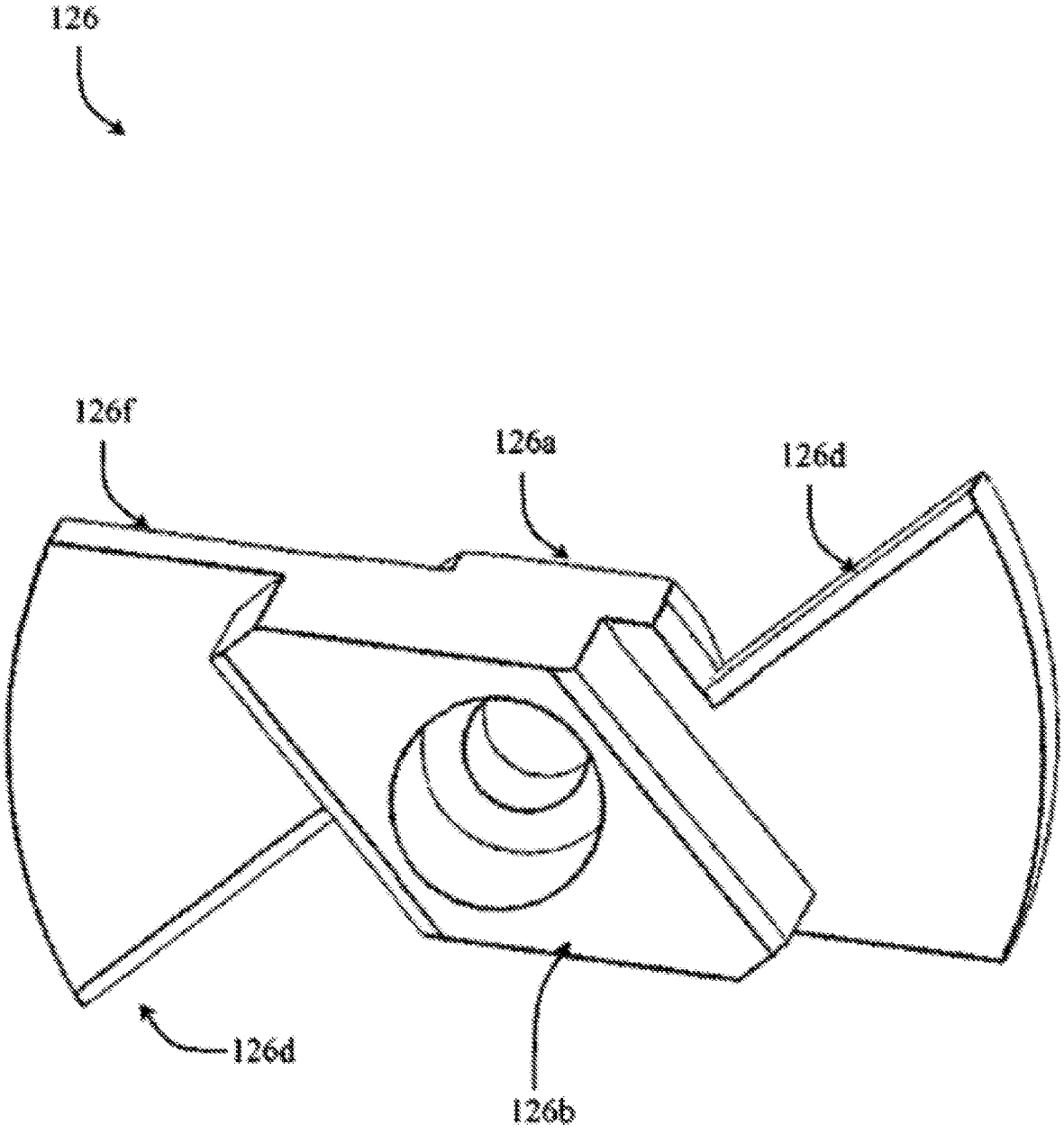
FIG. 5 is an illustrative example of the twist head of the tool, in accordance with the present invention.

Continuing with FIGS. 1 and 2, the work end 106 of the tool 100 further includes a wire twisting assembly 124. In accordance with an example embodiment of the present invention, the wire twisting assembly 124 includes a twist head 126 having a first end 126*a* and a second end 126*b*, a twist hub 128 coupled to the twist head 126 at the second end 126*b* of the twist head 126, and a twist shaft bushing 130 coupled to the twist hub 128 and configured at an opposite end of the twist hub 128 from the twist head 126. In accordance with an example embodiment of the present invention, the twist head 126 a fan or propeller blade design with two blades, as depicted in FIG. 5. The blades are designed with a flat edge 126*f* and a diagonal edge 126*d*, such that the diagonal edges 126*d* are designed to engage with the wire segment first end 112*a* and the wire segment second end 112*b* as the twist head 126 rotates. The wire segment 112 having each end 112*a*, 112*b* bent (as described elsewhere herein) engages with the twist head 126 diagonal edges 126*d* and as the twist head 126 rotates, the wire segment 112 twists about itself. The twist shaft bushing 130 prevents the wire segment 112 from twisting about the axis supporting the twist head 126 undesirably. As would be appreciated by one skilled in the art, the twist head 126 can be provided in different configurations other than a two blade design without departing from the scope of the present invention. For example, the twist head 126 can be a propeller with two or more blades with opposing angles.

Figure 9:
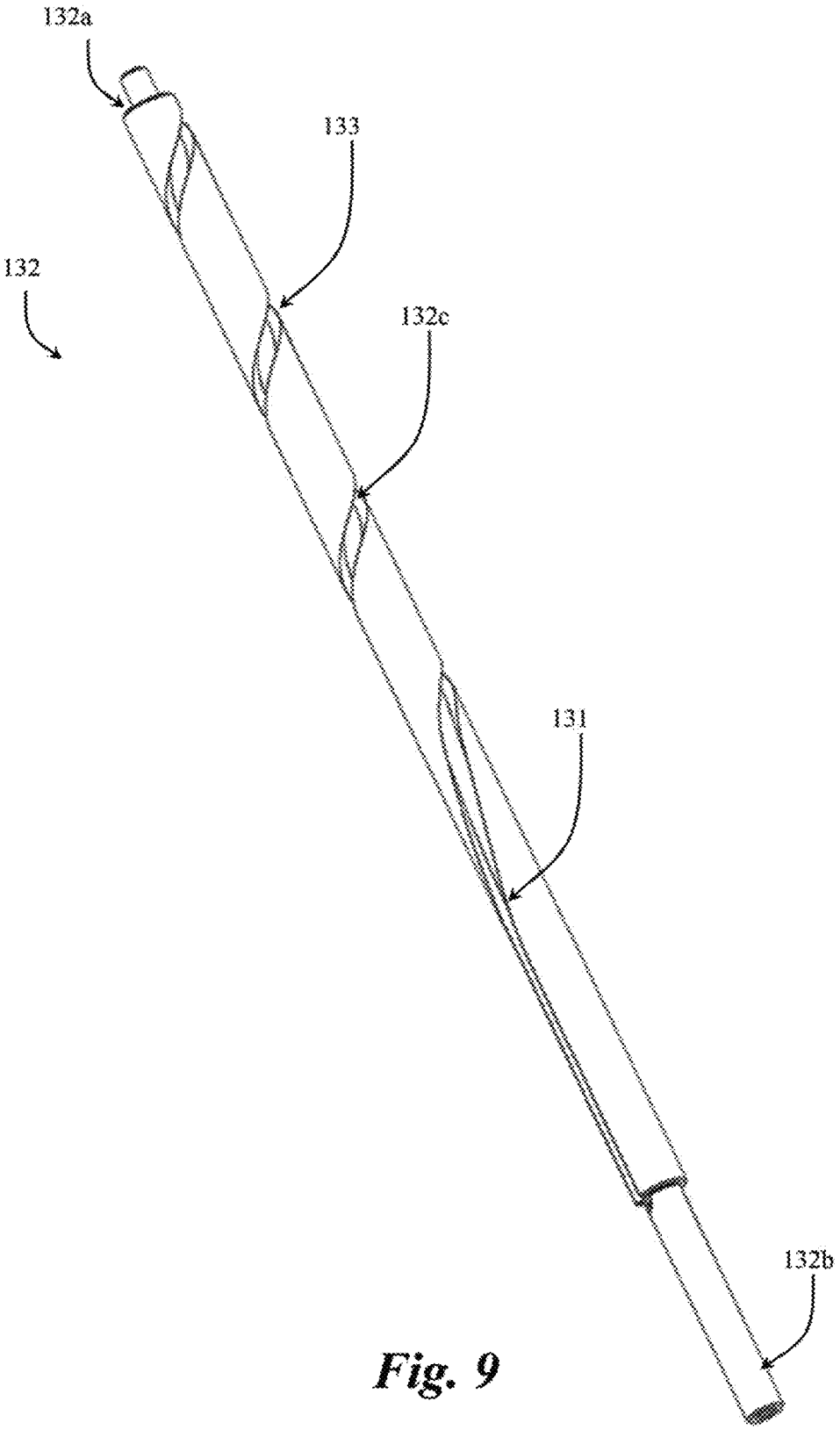
FIG. 9 is an illustrative example of the rotatable shaft, in accordance with the present invention.

The tool 100 also includes a rotatable shaft 132 disposed within the elongate housing 102 and having a first end 132*a* and a second end 132*b*, as depicted in FIG. 9. The second end 132*b* of the rotatable shaft 132 is coupled with the wire twisting assembly 124, in particular, to the twist shaft bushing 130 of the wire twisting assembly 124. In accordance with an example embodiment of the present invention, the rotatable shaft 132 includes a channel 132*c* (e.g., fluting or fluted column) that transitions from a generally straight section 131 to a generally helical section 133 disposed along a length of the shaft, as depicted in FIG. 9. The tool 100 further includes a slidable actuator 134 (see FIG. 7) coupled with the puller arm 116. The slidable actuator 134 includes a handle 136 and houses the trigger 114 and related triggering mechanisms. Additionally, the slidable actuator 134 includes at least one internal pin (not depicted) disposed in a manner engaging the channel 132*c* of the rotatable shaft 132. In accordance with an example embodiment of the present invention, the slidable actuator 134, and the components coupled thereto, is configured to slide vertically up and down the elongate housing 102. When the slidable actuator 134 slides vertically up the elongate housing 102, the at least one pin engages with the channel 132*c* of the rotatable shaft 132, and as the slidable actuator 134 continues in a vertical motion, the at least one pin in the channel 132*c* causes the rotatable shaft 132 to rotate (e.g., due to the force of the pin pushing against the generally helical sidewalls (of the generally helical section 133) of the channel 132*c* as the pin travels vertically up the channel 132*c*. As discussed herein, the rotation of the rotatable shaft 132 in turn causes the components (e.g., 126, 128, 130) of the wire twisting assembly 124 to also rotate.

In accordance with an example embodiment of the present invention, the tool 100 includes a spring 138 coupled to the elongate housing 102 and the slidable actuator 134. The spring 138 provides the force for pushing the wire into pulling position and compresses with actuation of the trigger mechanism. The spring 138 resets (extended) with the upward motion of the slidable actuator 134 and locks, ready for the next triggering. As would be appreciated by one skilled in the art, the functionality of the channel 132*c* in the rotatable shaft 132 and the spring 138 can be executed through a combination of different mechanisms without departing from the scope of the present invention. Specifically, any combination of mechanisms can be utilized which result in the rotatable shaft 132 rotating in response to the slidable actuator 134 being pulled vertically without departing from the scope of the present invention. For example, a combination of chains, gears, pistons, hydraulics, electronic motors, etc. can be utilized to cause such functionality.

In accordance with an example embodiment of the present invention, the slidable actuator 134 is coupled to the first end 116*a* of the puller arm 116 and causes the puller arm 116 to pull upward in the direction of the slidable actuator 134. In accordance with an example embodiment of the present invention, the work end 106 of the tool 100 includes a cam plate 140 encasing the puller arm 116. The cam plate 140 includes a channel 140*c*, as depicted in FIG. 1, configured to receive a pin or pins with bearings attached thereto on the puller arm 116 to provide a guided path for the puller arm 116 to follow when the pulled up by the slidable actuator 134.

FIG. 2 depicts an illustrative example of the wire twisting assembly 124 of the tool 100, as discussed with respect to FIG. 1. In particular, FIG. 2 depicts a close up view of the different components that make up the work end 106 of the tool 100. The work end 106, as depicted in FIG. 2, includes the wire feed 110, the wire segment 112, the puller arm 116, the wire engager 118, the catch pin 120, the wire forming block 122, the wire twisting assembly 124, the twist head 126, and the twist hub 128. The wire segment 112, as depicted in FIG. 2, shows the wire segment already pulled and bent into the twisting position (e.g., with the first end 112*a* at one end of the twist head 126 and the second end 112*b* at the opposite end of the twist head 126).

Figure 4A:
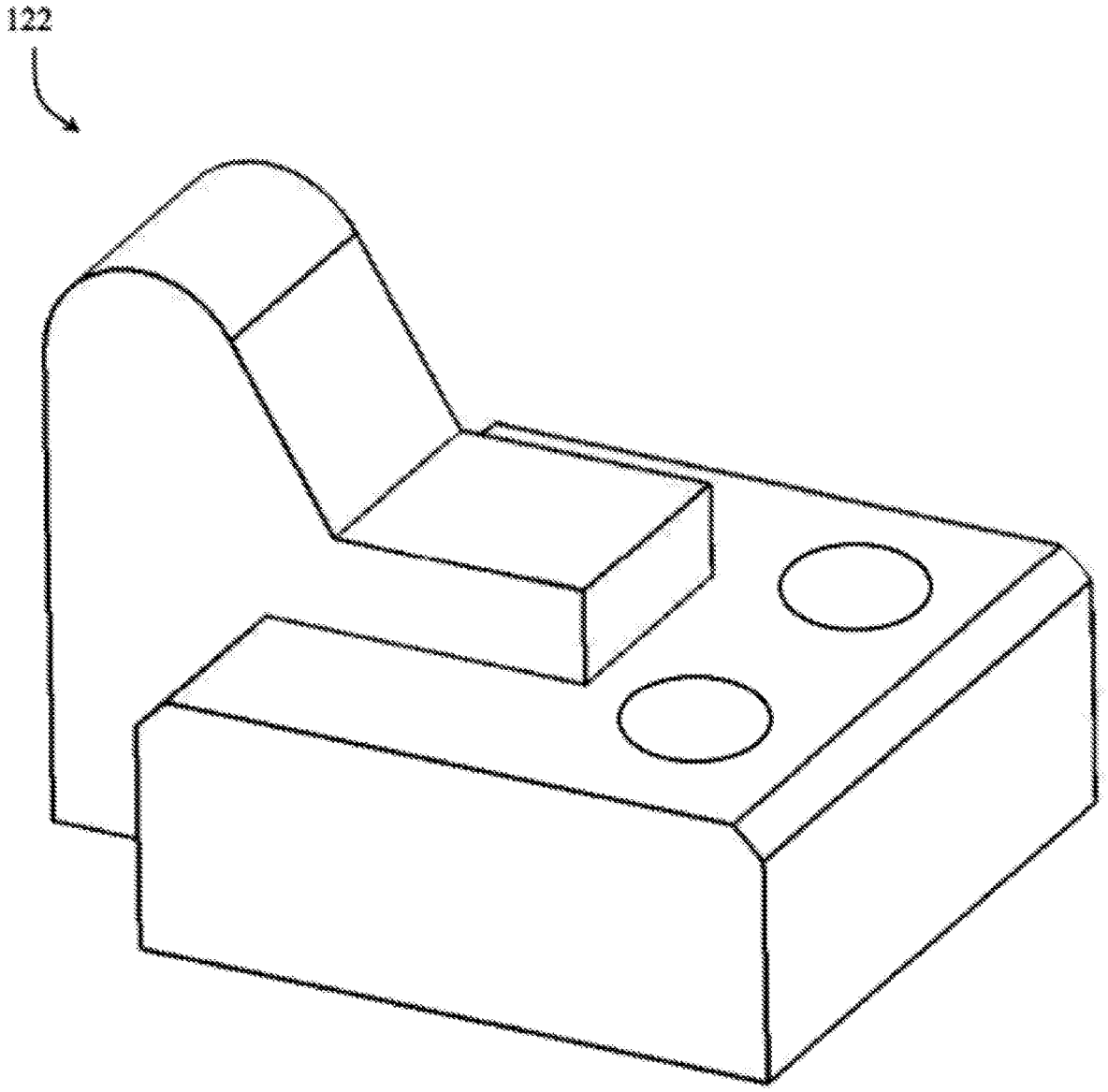
FIGS. 4A and 4B are illustrative examples of the wire forming block of the tool, in accordance with the present invention.
Figure 6:
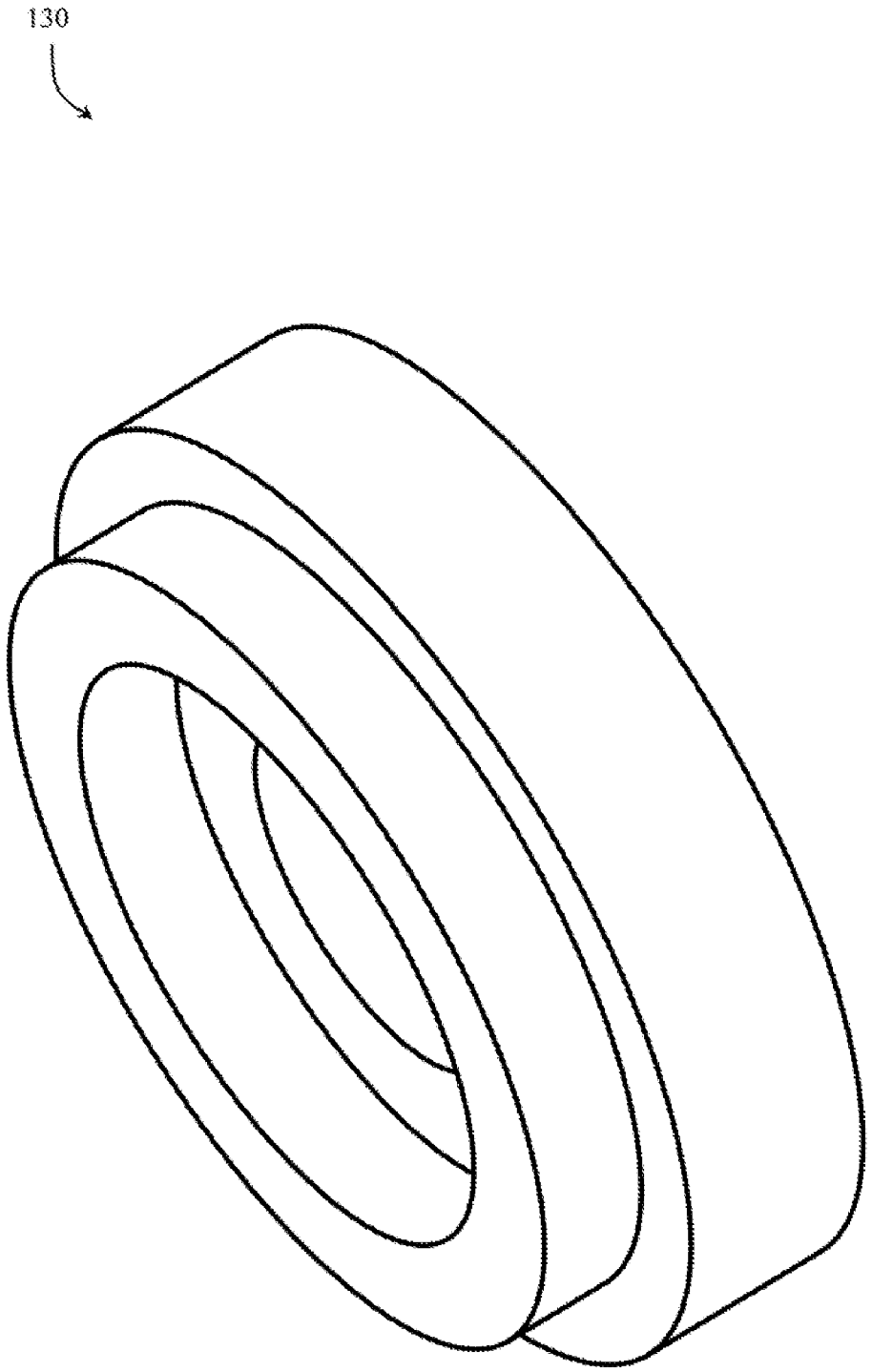
FIG. 6 is an illustrative example of the twist hub of the tool, in accordance with the present invention.

FIG. 3 depicts an illustrative example of the wire engager 118 of the tool 100, as discussed with respect to FIG. 1. In particular, FIG. 3 depicts an example illustration of the wire engager 118 including the catch pin 120. FIG. 4A depicts an illustrative example of the wire forming block 122 of the tool 100, as discussed with respect to FIG. 1. FIG. 5 depicts an illustrative example of the twist head 126 of the tool 100, as discussed with respect to FIG. 1. FIG. 6 depicts an illustrative example of the twist hub 128 of the tool 100, as discussed with respect to FIG. 1. The twist hub 128 and twist shaft bushing 130 facilitate holding formed ends 112*a*, 112*b* of the wire segment 112 in place as they are twisted by the twist head 126 and also helps keep wire segment 112 from wrapping around the rotatable shaft 132.

Figure 7:
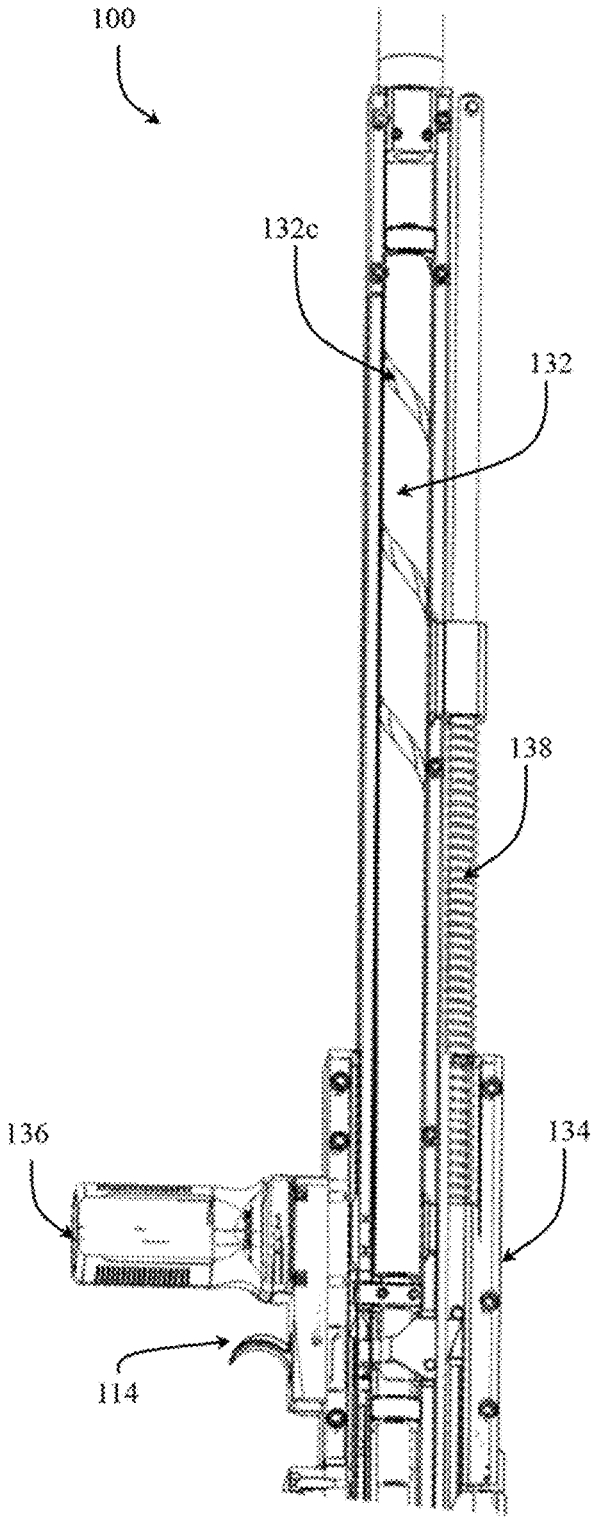
FIG. 7 is an illustrative example of the slidable actuator and rotatable shaft of the tool, in accordance with the present invention.

FIG. 7 depicts an illustrative example of the slidable actuator 134 and the rotatable shaft 132 of the tool 100, as discussed with respect to FIG. 1. In particular, FIG. 7 depicts a close up view of the different components that make up the handle 104 end of the tool 100. The handle 104 end of the tool, as depicted in FIG. 7, includes the trigger 114 (and related mechanisms), the rotatable shaft 132 (with channel 132*c*), the slidable actuator 134, handle 136, and spring 138.

Figure 4B:
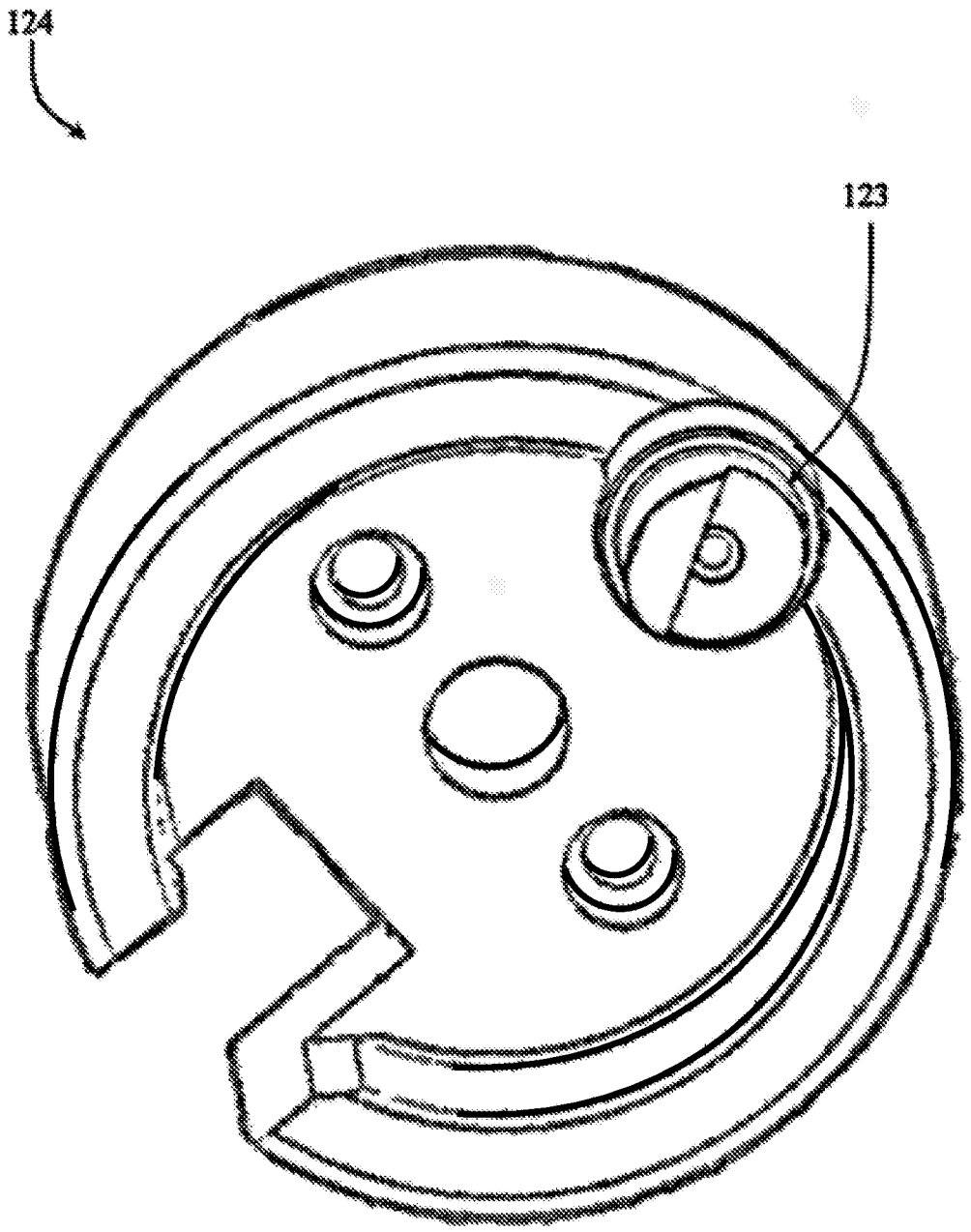
Figure 8A:
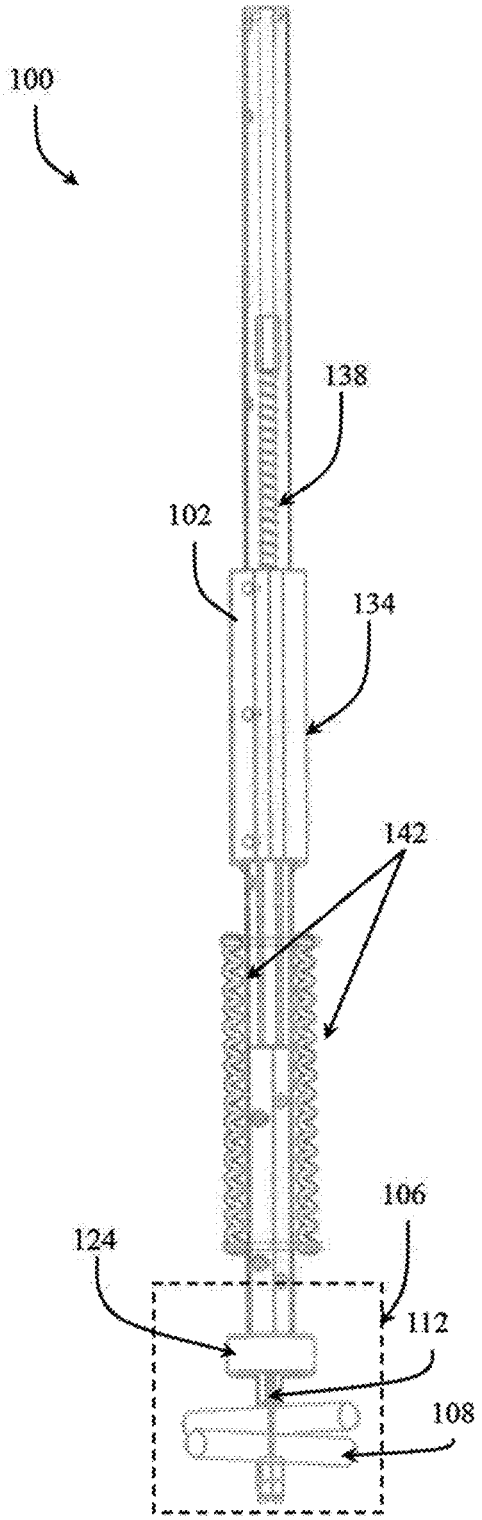
FIGS. 8A and 8B are illustrative examples of the detent spring assembly, in accordance with the present invention.
Figure 8B:
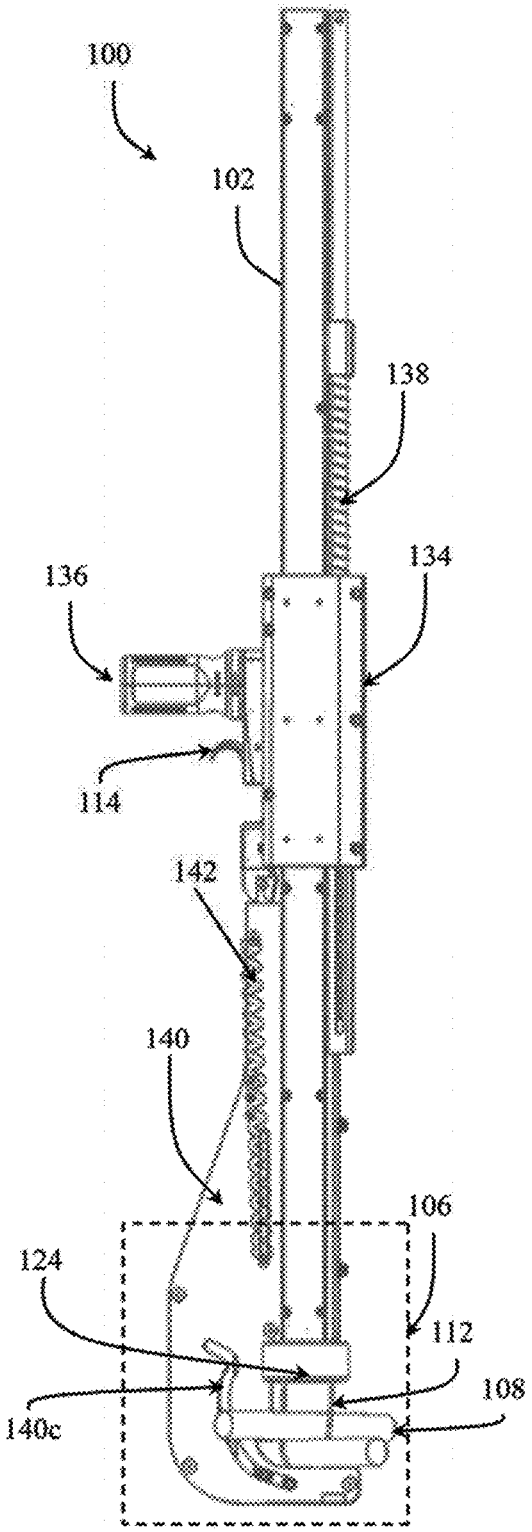

FIGS. 8A and 8B depict an illustrative example embodiment of the tool 100 including two detent springs 142 configured on either side of the tool 100. FIG. 8A depicts top view of the tool 100 and FIG. 8B depicts a side view of the tool 100. The tool 100, as depicted in FIGS. 8A and 8B includes the elongate housing 102, the handle 104, the trigger 114, the slidable actuator 134, the handle 136, the spring 138 and the various components of the work end 106 as they relate to the rebar and the wire segment 112, as discussed in FIGS. 1-7. FIGS. 8A and 8B also depict the additional components of the detent springs 142 located on either side of the cam plate 140. The detent springs 142 are configured to hold the puller arm 116 and engager 118 in the "up" position while being acted upon by the force of the twister head 126 as the twister head 126 pulls the positioned wire 112 off of the conical frustum pin of the engager 118 and out of the drive shaft and across the upper wire forming block 123 (as depicted in FIG. 4B) located on the underside of the cowling of the twisting assembly 124.

FIG. 9 depicts an illustrative example of the rotatable shaft 132 of the tool 100, as discussed with respect to FIGS. 1, 7, 8A, and 8B. In particular, FIG. 9 depicts the rotatable shaft 132 including the generally straight section 131 of the channel 132*c* generally helical section 133 of the channel 132*c*. The second end 132*b* of the rotatable shaft 132 connects to the work end 106 of the tool 100.

Figure 10A:
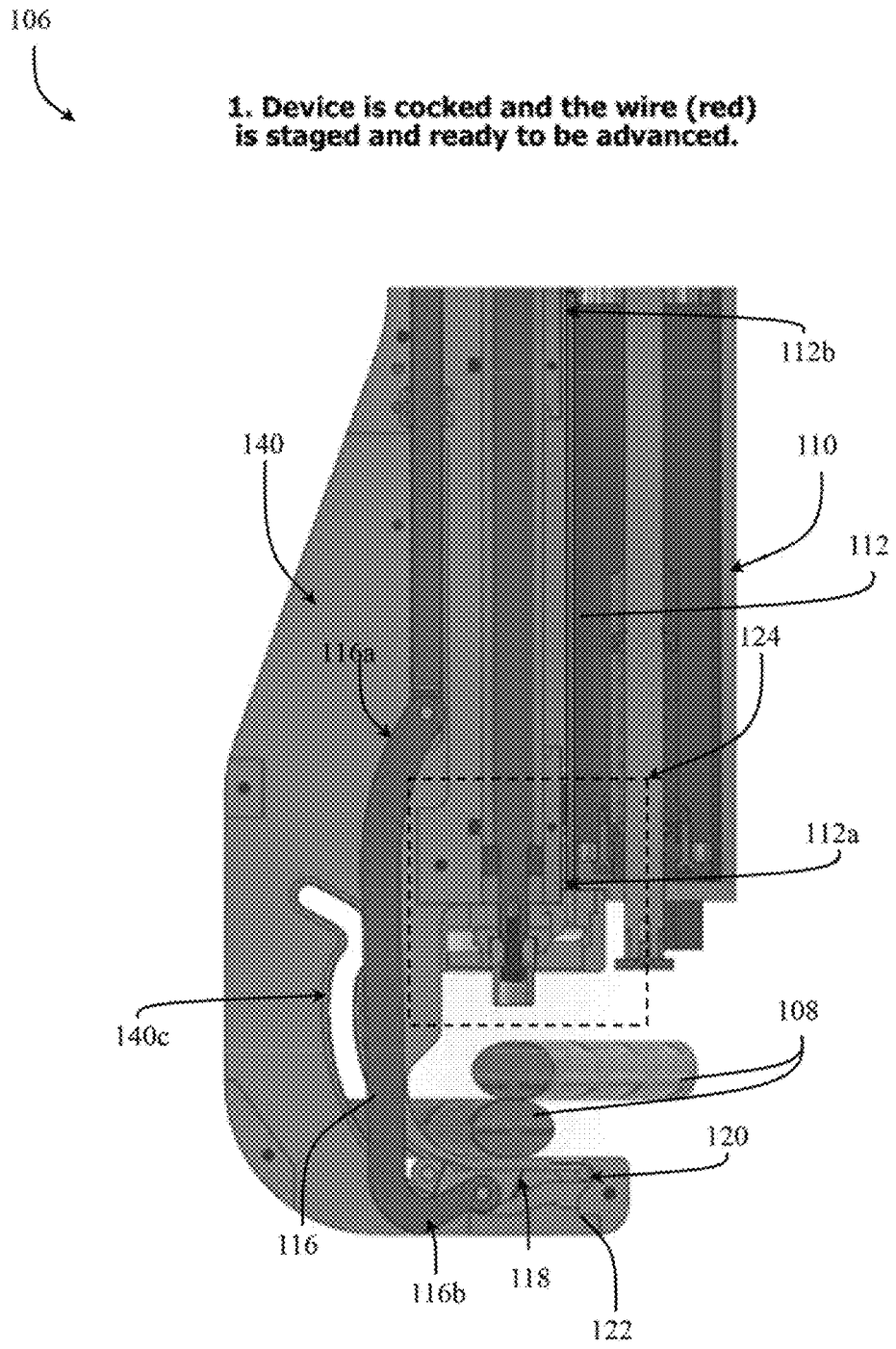
FIGS. 10A, 10B, 10C, and 10D are illustrative examples of the progressive operation of the work end of the tool, in accordance with the present invention.
Figure 10B:
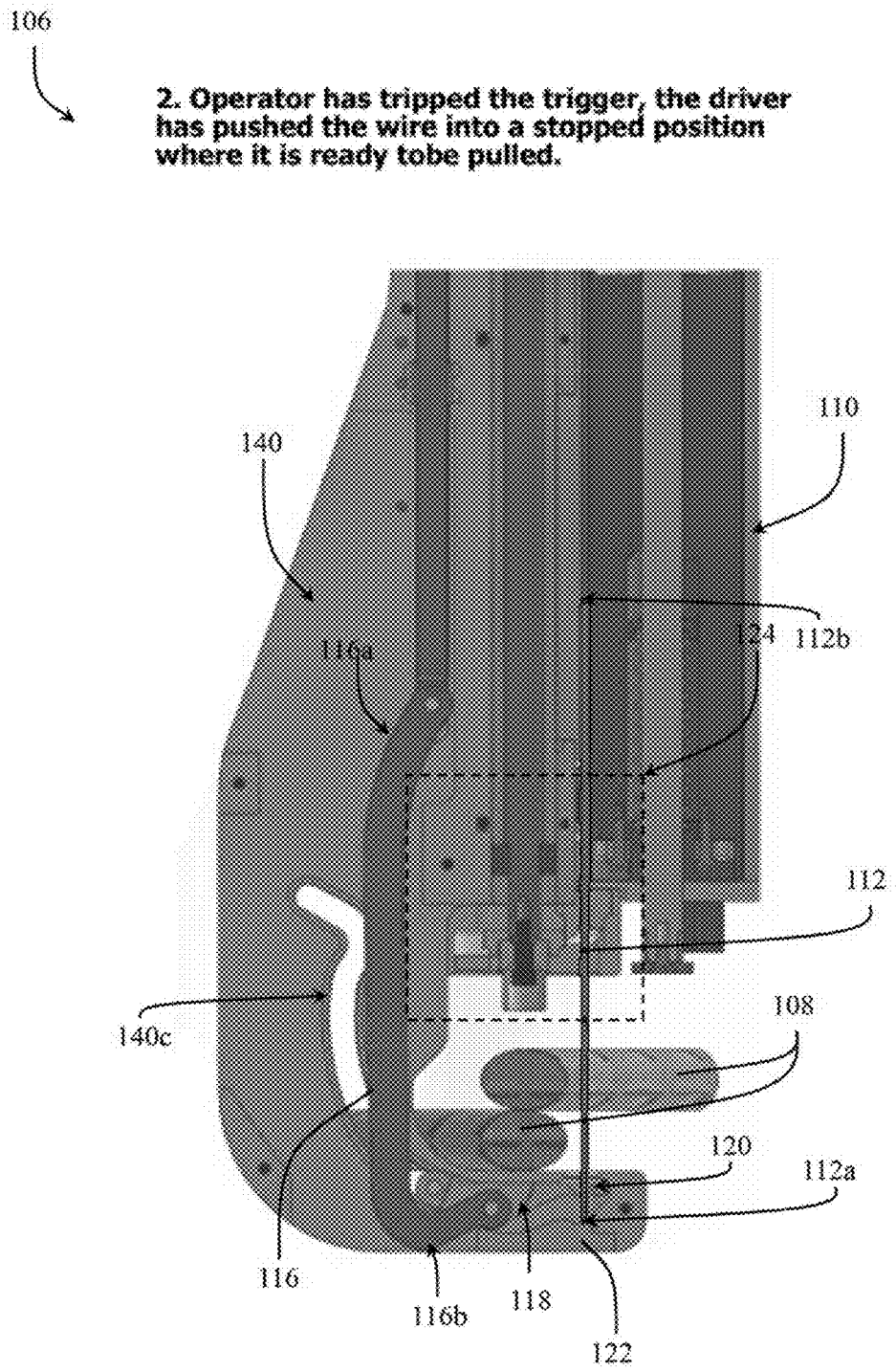

In operation, a user positions objects to be tied in the opening of the work end 106. For example, the user can place two intersecting pieces of rebar 108 in the opening of the work end 106 of the tool 100, as depicted in FIG. 10A. With a wire segment 112 disposed in the wire feed 110, the user can discharge a wire segment 112 from the wire feed 110 into the wire engager 118. The wire feed 110 includes a wire drive shaft and a drive pin which are configured to push the wire segment 112 down the wire drive shaft and into a position for the pulling operation, discussed in greater detail herein. The discharging of the wire segment 112 can be in response to the user actuating the trigger 114 mechanism on the tool 100 causing a release in energy of a spring-loaded driver, which pushes the piece of wire segment 112 into a position to begin the process of forming, wrapping, and tying the at least one wire segment 112 around the rebar 108, as depicted in FIG. 10B. As would be appreciated by one skilled in the art, the wire segment 112 can be discharged in any combination of other methods. For example, the operator can cock the tool 100 to discharge the wire segment 112.

Figure 10C:
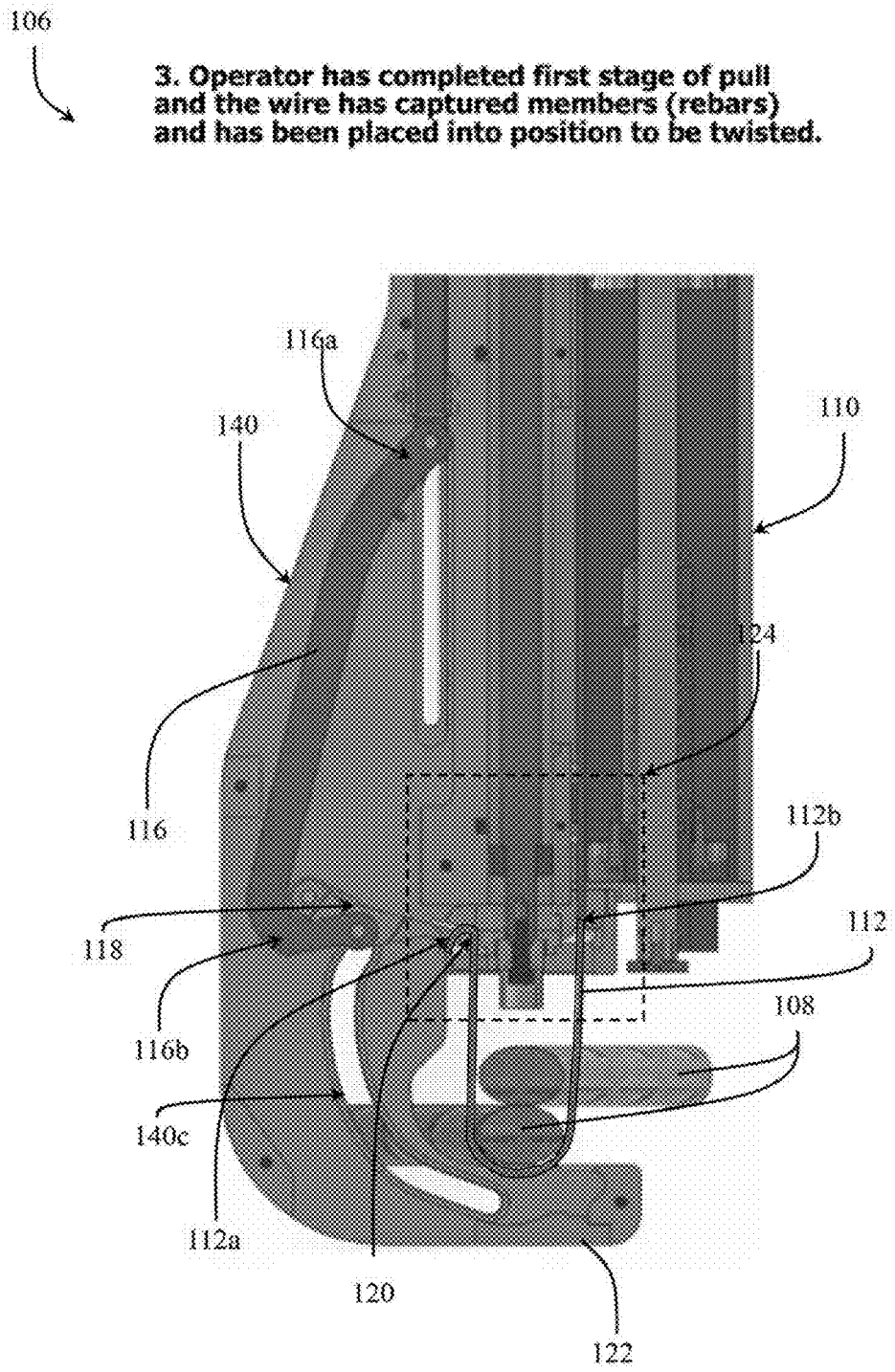

With the wire segment 112 in position, the operator pulls vertically upward on the handle 136, which pulls the slidable actuator 134 in a vertical direction. The action of pulling the slidable actuator 134 vertically upwards simultaneously engages the puller arm 116, which pulls the wire from under the rebar 108 and up into a twist position. In particular, the slidable actuator 134 is slid up and away from the work end 106, which action simultaneously pulls the wire segment 112 across the wire forming block 122 bending an end of the wire segment 112 into a first catch (bend). With the first catch bend formed, the wire segment 112 catches the catch pin 120 in the wire engager 118, causing the wire segment to be removably coupled with the catch pin 120 of the wire engager 118. The slidable actuator 134 continues up and away from the work end 106, causing the wire engager 118 to pull additional length of the wire segment 112 out and away from the wire feed 110 until reaching a desired length that is less than a full length of the wire segment 112. In other words, pulling of the slidable actuator 134 causes the puller arm 116/wire engager 118 to pull the wire segment 112 below the rebar 108 being tied, pull the wire segment 112 up and around the rebar 108 to place both ends 112*a*, 112*b* of the wire segment 112 into the exact position where the twist head 126 can effectively twist/tie the wire segment 112, as depicted in FIG. 10C.

Figure 10D:
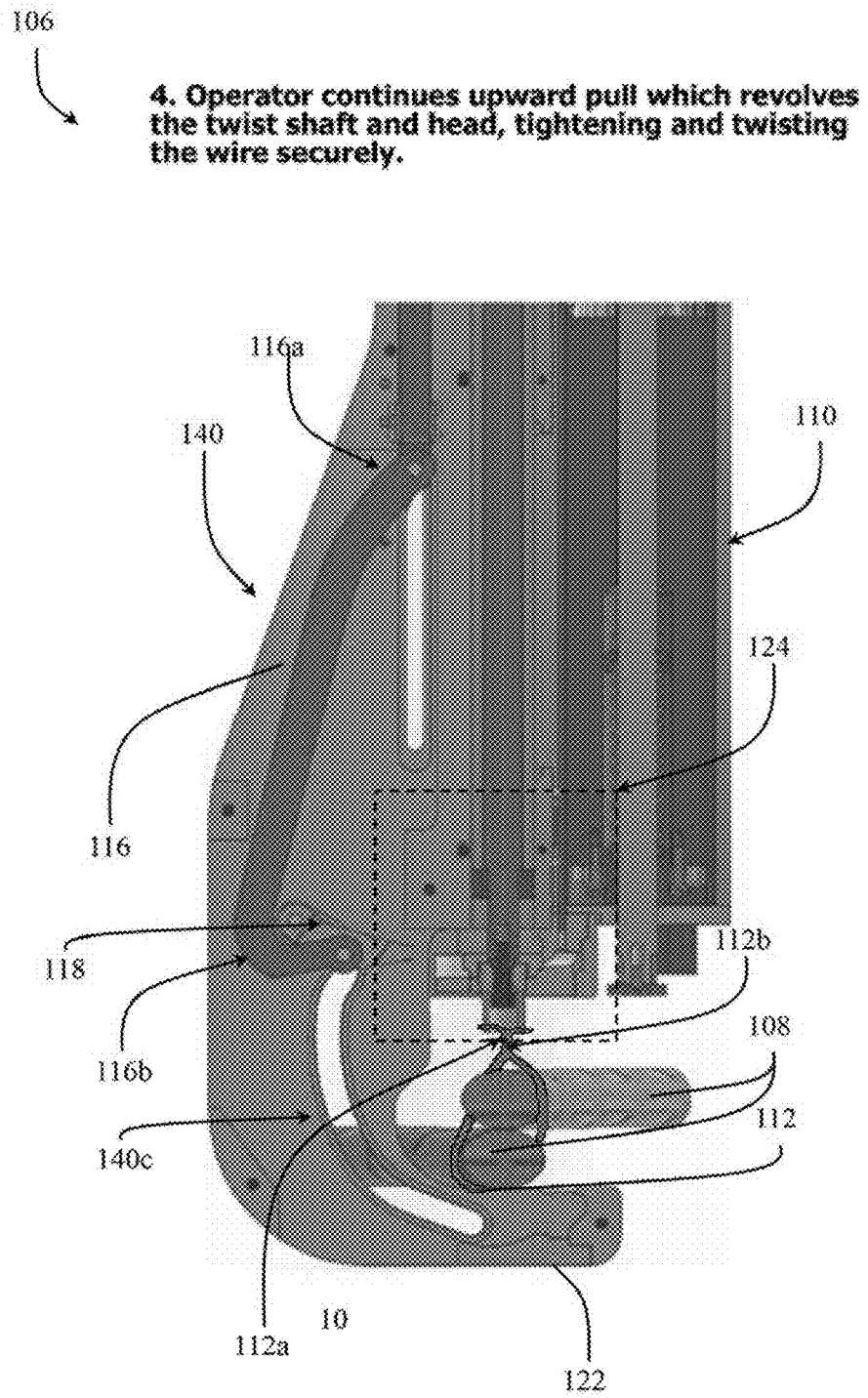

A continued upward pull engages the wire twisting assembly 124 which rotates and twists/ties the ends 112*a*, 112*b* of the wire segment 112. In particular, causes the at least one pin of the slidable actuator 134 to travel along the generally straight section 131 of the channel 132*c* of the rotatable shaft 132 and the slidable actuator 134 continues up and away from the work end 106, causing the at least one pin of the slidable actuator 134 to enter and travel along the generally helical section 133 of the channel 132*c* of the rotatable shaft 132, which in turn causes the rotatable shaft 132 to rotate and simultaneously cause the wire twisting assembly 124 to rotate. The rotation action of the wire twisting assembly 124 causes the wire segment 112 to bend as it moves past an end of the wire feed 110, creating a second catch (bend) at the second end 112*b* of the wire segment 112 opposite the first catch at the first end 112*a* of the wire segment 112. In accordance with an example embodiment of the present invention, the work end 106 includes another wire forming block 123 or cam inside the cowling of the twisting assembly 124. FIG. 4B depicts an underside view of the cowling of the wire twisting assembly 124 with the upper wire forming block 123 attached thereto. The upper wire forming block 123 which operates the same way as the wire forming block 122 of FIG. 4A to form the second catch at the second end 122*b* of the wire segment 112. The slidable actuator 134 continues up and away from the work end 106, causing the rotatable shaft 132 to rotate and simultaneously causing the wire twisting assembly 124 to rotate, the twist head 126 of the wire twisting assembly 124 engaging the first catch and the second catch of the wire segment 112 (e.g., at the diagonal edges 126*d* of the twist head 126), and causing the wire segment 112 to twist about itself, as depicted in FIG. 10D.

Figure 11:
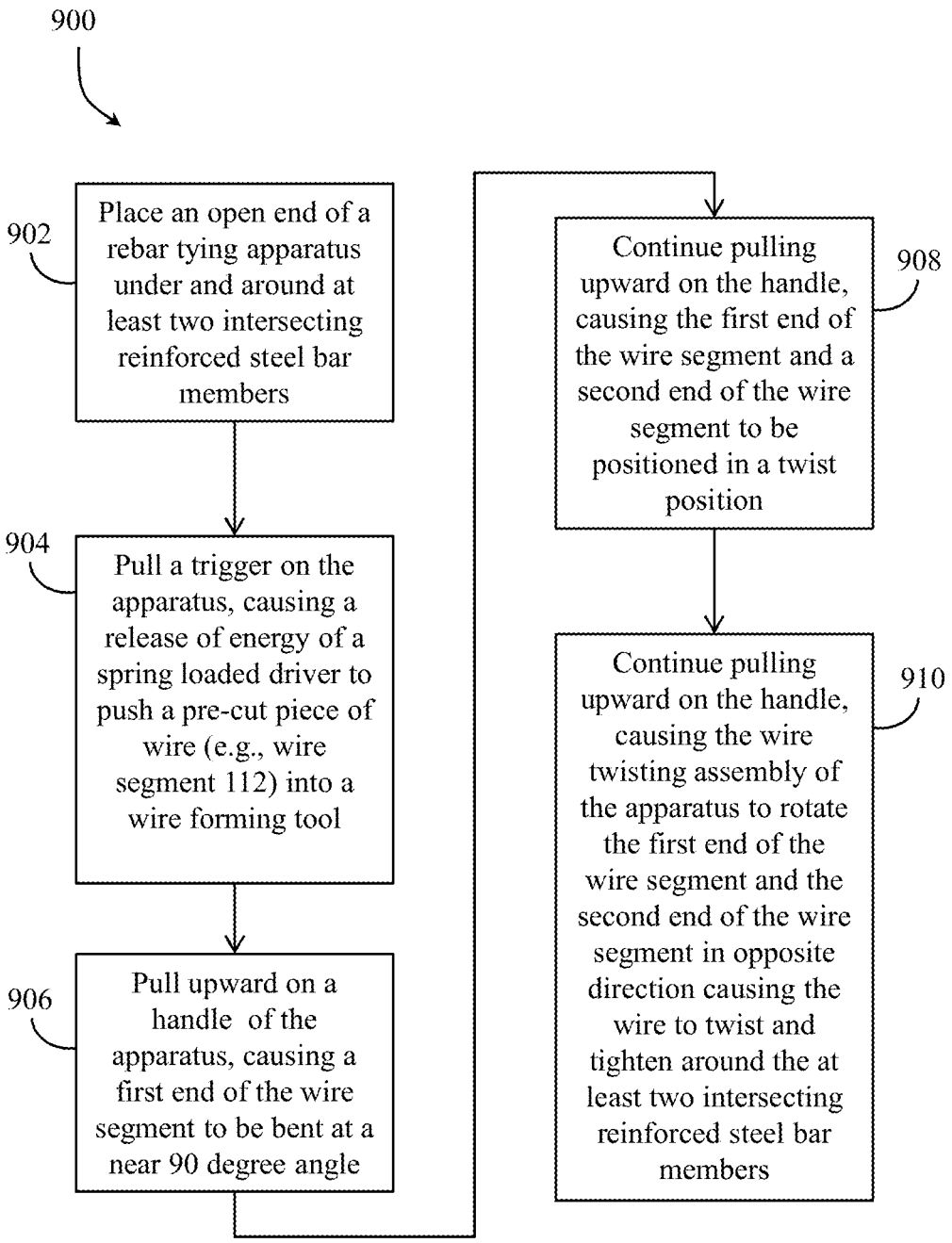
FIG. 11 is an illustrative flowchart of the method of use of the tool, in accordance with the present invention.

FIG. 11 depicts an exemplary flow chart depicting implementation of the present invention. Specifically, FIG. 11 depicts an exemplary flow chart showing the operation 900 of the tool 100, as discussed with respect to FIGS. 1-10D. At step 902, operation 900 begins with placing an open end of a wire tying apparatus (e.g., tool 100) under and around at least two intersecting reinforced steel bar members (e.g., rebar 108). At step 904 a user initiates the wire tying process by actuating a trigger (e.g., trigger 114) on the apparatus, such that actuating and/or pulling the trigger causes a release of energy of a spring loaded driver to push a wire segment (e.g., wire segment 112) into a wire forming tool (e.g., the wire forming block 122 of the apparatus). At step 906 a user pulls upward on a handle (e.g., handle 136) of the apparatus, such that pulling upward on the handle causes a first end (112*a*) of the wire segment to be bent at a near 90 degree angle. At step 908 a user continues the pulling upward on the handle, such that the continued pulling upward causes the first end of the wire segment and a second end (112*b*) of the wire segment to be positioned in a twist position proximal to a wire twisting assembly (e.g., wire twisting assembly 124). At step 910 the user continues the pulling upward on the handle, such the continued pulling upward causes the wire twisting assembly of the apparatus to rotate the first end of the wire segment and the second end of the wire segment in opposite direction causing the wire to twist and tighten around the at least two intersecting reinforced steel bar members (e.g., rebar 108). Additionally, the step 910 can include the apparatus dispensing the wire segment from an indexing drum magazine, wind up spring, or other mechanism (e.g., in the wire feed 110) into a driver channel.

As utilized herein, the terms "comprises" and "comprising" are intended to be construed as being inclusive, not exclusive. As utilized herein, the terms "exemplary", "example", and "illustrative", are intended to mean "serving as an example, instance, or illustration" and should not be construed as indicating, or not indicating, a preferred or advantageous configuration relative to other configurations. As utilized herein, the terms "about", "generally", and "approximately" are intended to cover variations that may exist in the upper and lower limits of the ranges of subjective or objective values, such as variations in properties, parameters, sizes, and dimensions. In one non-limiting example, the terms "about", "generally", and "approximately" mean at, or plus 10 percent or less, or minus 10 percent or less. In one non-limiting example, the terms "about", "generally", and "approximately" mean sufficiently close to be deemed by one of skill in the art in the relevant field to be included. As utilized herein, the term "substantially" refers to the complete or nearly complete extent or degree of an action, characteristic, property, state, structure, item, or result, as would be appreciated by one of skill in the art. For example, an object that is "substantially" circular would mean that the object is either completely a circle to mathematically determinable limits, or nearly a circle as would be recognized or understood by one of skill in the art. The exact allowable degree of deviation from absolute completeness may in some instances depend on the specific context. However, in general, the nearness of completion will be so as to have the same overall result as if absolute and total completion were achieved or obtained. The use of "substantially" is equally applicable when utilized in a negative connotation to refer to the complete or near complete lack of an action, characteristic, property, state, structure, item, or result, as would be appreciated by one of skill in the art.

Numerous modifications and alternative embodiments of the present invention will be apparent to those skilled in the art in view of the foregoing description. Accordingly, this description is to be construed as illustrative only and is for the purpose of teaching those skilled in the art the best mode for carrying out the present invention. Details of the structure may vary substantially without departing from the spirit of the present invention, and exclusive use of all modifications that come within the scope of the appended claims is reserved. Within this specification embodiments have been described in a way which enables a clear and concise specification to be written, but it is intended and will be appreciated that embodiments may be variously combined or separated without parting from the invention. It is intended that the present invention be limited only to the extent required by the appended claims and the applicable rules of law.

It is also to be understood that the following claims are to cover all generic and specific features of the invention described herein, and all statements of the scope of the invention which, as a matter of language, might be said to fall therebetween.

What is claimed is:

1. A method for tying a plurality of members together with a wire, wherein the wire comprises a leading end and a following end, the method comprising:

wherein a wire tying apparatus comprises a housing having a handle at one end and a work end, a wire feed configured to contain at least one wire segment having a first end and a second end, a puller arm includes a wire engager, a wire forming tool located proximate the work end of the housing, a wire twisting assembly;

arranging the members in a required configuration positioning the work end of the wire tying apparatus adjacent the arranged members;

actuating the wire tying apparatus to push one wire segment adjacent the arranged members;

further actuating the wire tying apparatus to bend the wire segment around the arranged members forming a catch bend between the wire and wire forming tool to facilitate connection of the wire segment to the wire forming tool and connect the first end of the wire segment to the wire engager while retaining the second end of the wire segment within the wire feed;

further actuating the wire tying apparatus to cause the puller arm to pull the first end of the wire segment up into a twisting position so that the first end of the wire segment and the second end of the wire segment are positioned in the twist position proximal to the wire twisting assembly and around the arranged members;

further actuating the wire tying apparatus to rotate the first end of the wire segment and the second end of the wire segment in opposite direction causing the wire segment to twist and tighten around the arranged members.

2. The method of claim 1, further comprising the wire feed comprises the wire segments are contained within an indexing drum magazine that feeds into a driver channel.

3. The method of claim 1, further comprising extracting the wire tying apparatus from the arranged members while leaving the twisted wire segment in place and cinched around the arranged members.

* * * * *